United States Patent [19]

Alford

[11] 4,203,118

[45] May 13, 1980

[54] ANTENNA FOR CROSS POLARIZED WAVES

[76] Inventor: Andrew Alford, 15 Sixth Rd., Woburn, Mass. 01801

[21] Appl. No.: 895,344

[22] Filed: Apr. 10, 1978

[51] Int. Cl.[2] ..... H01Q 9/18

[52] U.S. Cl. ..... 343/727; 343/801; 343/806; 343/890

[58] Field of Search ..... 343/725, 726, 727, 729, 343/730, 806, 890, 891, 801

[56] References Cited

U.S. PATENT DOCUMENTS

| | | | |
|---|---|---|---|
| 3,409,893 | 11/1968 | Siukola | 343/891 |
| 4,129,871 | 12/1978 | Johns | 343/727 |

*Primary Examiner*—Eli Lieberman

[57] ABSTRACT

An antenna comprising a metal panel on which are mounted two parallel collinear dipole arrays spaced on the order of a half-wavelength from each other. Each dipole array is of the order of 9 wavelengths long and is fed at its center. Half way between the two collinear arrays is mounted a zigzag antenna with its center located half way between the centers of the collinear arrays which may be staggered with respect to each other. The two collinear arrays are fed in the same relative phase with each other. The zigzag antenna and the dipole array may be fed from different sources operating at different frequencies or they may be fed from the same source and phased to radiate circularly polarized waves. A plurality of the panel antennas may be mounted around a metal cylinder to serve as an omnidirectional antenna. A square tower may serve as the metal cylinder. Several levels of one to four antennas may be mounted on a square tower depending on the shape of the area to be served.

9 Claims, 4 Drawing Figures

ANTENNA FOR CROSS POLARIZED WAVES

This invention relates to transmitting antennas that may be used for transmitting vertically polarized waves over a band of frequencies and horizontally polarized waves over another band frequencies. They can also be used to radiate elliptically polarized waves over a single band of frequencies. When desired the ellipticity of the radiated waves may be adjusted so that they are substantially circularly polarized.

The antenna of this invention may, for example, be used to radiate nearly adjacent band of frequencies used for Multipoint Distribution Service presently assigned frequencies in the vicinity of 2150 MHz. By radiating one band of frequencies as vertically polarized waves and another band of frequencies as horizontal waves it is possible to increase the separation between the two neighbouring channels at the receivers and thus minimize the possibility of interference.

The antenna of this invention may also be used for radiating television frequencies particularly in the so called UHF band. This antenna enables one to radiate television signals in the form of circularly polarized waves which, when received by means of circularly polarized antennas, result in cleaner pictures. Ghosting due to reflections from flat metal surfaces, as well as many other vertical surfaces, would be reduced because reflected waves would arrive, as circularly polarized waves having opposite sense of rotation as compared to the waves received directly from the station.

The desirability of using circularly polarized waves for transmitting television signals, particularly at U.H.F. frequencies, has been appreciated for some time. In practice, however, this was difficult to achieve because experience has shown that at U.H.F. frequencies it is necessary to use very high values of effective radiated power which is the product of antenna gain times the power delivered to the antenna. Because of the high cost of high power transmitters and of wave guides and coaxial lines used to transport high power to the antenna it has been found necessary for reasons of overall economy to use antennas having in each polarization very high gains of the order of 25, 30 or sometimes even over 40 as compared to the half wave dipole.

For linearly polarized waves it was found possible to design at least two general types of antennas which could be built at a reasonable cost without using very complex feeding systems. One type of antenna consists of a vertical metal cylinder with vertical slots. These slots are fed by coupling them to an inner conductor within the vertical cylinder. The second type of antenna comprises a square tower having a cross sectional dimension close to a wavelength. Zigzag antennas are mounted on panels located on the four faces of the square tower. Each of these zigzag antennas is made 8 or 9 wavelengths long and requires only one coaxial feeder. In order to get very high values of gain three or four levels of such zigzag antennas are used making the total aperture of the order of 25 to 40 wave lengths.

The total number of feed points in a three level zigzag antenna is four times 3, that is, 12. If individual dipoles were used, in place of the zigzags, a very large number of individual feeders would have to be connected in pairs, quadruples etc. The number of feed points would be of the order of 160. Since the likelihood of breakdowns is usually roughly proportional to the number of feed points the reliability of such a device would not be very good unless it were built with extreme care and, therefore, at a considerable expense.

Efficient zigzag antennas have been known for a long time, having been described by O. MacDonald Woodward Jr in U.S. Pat. No. 2,759,183 dated Aug. 14, 1956. A comparably efficient panel antenna for radiating vertically polarized waves was described more recently by A. Alford in U.S. Pat. No. 4,031,537 dated June 21, 1977.

The antenna of the present invention comprises two types of structures; A zigzag antenna such as, for example, disclosed by Woodward and two collinear dipole arrays, such as, for example, disclosed by Alford.

Since the spacing of the radiating elements of the Alford collinear dipole array from the reflecting sheet may be made smaller than the spacing of the zigzag, it is possible to locate the zigzag directly over a collinear array. This arrangement, however, does not result in satisfactory performance of the antenna because the signal fed into the collinear array induces large currents in the zigzag. Conversely, the zigzag induces large currents in the collinear array. This coupling is so large that it makes it difficult, if not impossible, to get a circularly polarized signal by feeding both arrays. It was likewise not possible to radiate vertically polarized signals without radiating a horizontally polarized signal of comparable magnitude.

The arrangement which I found to give good results comprises two collinear dipole arrays arranged parallel to each other at a distance which is comparable to a half wavelength. The centerline of the zigzag is located in the plane perpendicular to the reflecting sheet and located half way between the two collinear arrays. Best results are obtained when the two collinear arrays are staggered with respect to each other in their vertical positions by one half of the full cycle of the zigzag. This arrangement results in very little coupling between the zigzag antenna and the two arrays when they are fed in the same phase. One reason for this result is that currents induced by one of the two arrays tend to be cancelled by the other.

The overall length of the panel, including the portions of the sheet which extend beyond the ends of the colinear arrays, is around 10 wavelengths. Each half of the zigzag should preferably be made with about 6 complete cycles. When the number of zigzag cycles, per unit length, is increased, the attenuation of the signal becomes excessive so that only the central portion of the zigzag acts as an effective radiater.

One object of this invention is a combination of two high gain antennas mounted on the same reflecting metal plate radiating substantially similar beams in the same directions with electric field from one antenna being at right angles to the electric field radiated by the other antenna and with substantially no intercoupling between the two antennas.

Another object of this invention is a high gain panel antenna with few feed points for radiating a beam of substantially circularly polarized waves.

Still another object of this invention is an omnidirectional antenna for broadcasting circularly polarized waves comprising four high gain combination panel antennas of this invention mounted on four faces of a square tower.

A further object of this invention is an omnidirectional antenna for broadcasting circularly polarized waves comprising a plurality of combined panel antennas of this invention arranged at equal intervals around a tower having a cross section which is either a circle of a regular polygon with equal sides.

Still another object of this invention is a directional antenna for broadcasting circularly polarized signals over a sector comprising a plurality of combined panel antennas of this invention mounted on some of the sides of a mast having the cross section of a polygon or mounted part way around a circular cylinder.

Figure 2:
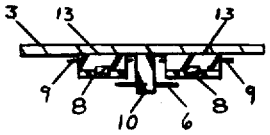
FIG. 2 is a simplified top view of the combined panel shown in FIG. 1.
Figure 1:
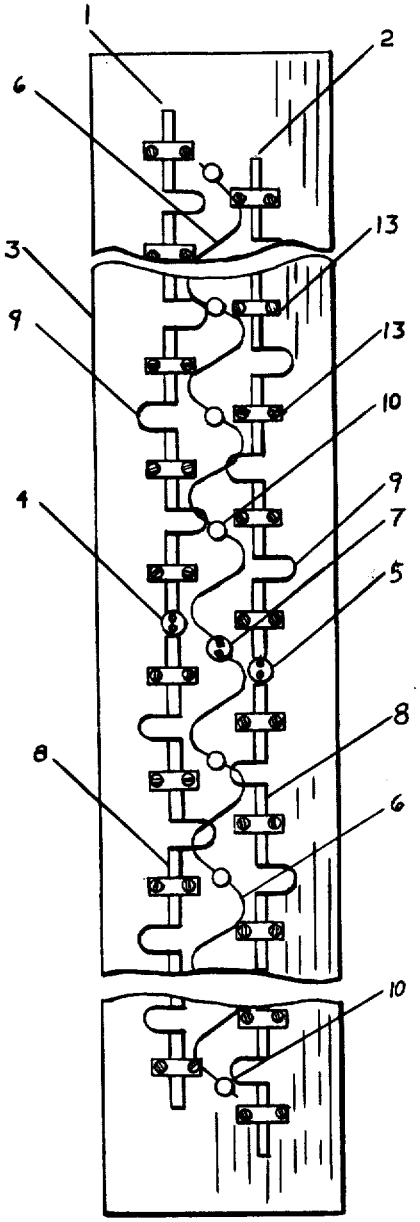
FIG. 1 shows a face view of the combined panel antenna of the invention.
Figure 3:
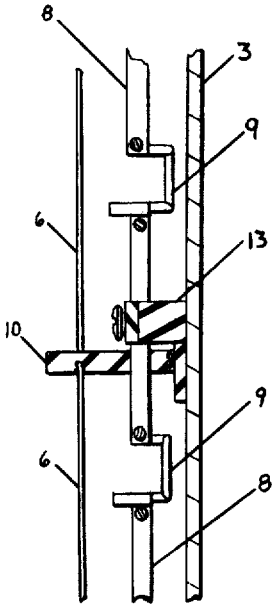
FIG. 3 shows a portion of the side view of the panel of FIG. 1 on a magnified scale.

In FIG. 1 is shown one embodiment of this invention. In this FIGS. 1 and 2 are collinear dipole arrays of the type disclosed in U.S. Pat. No. 4,031,537. These arrays are mounted parallel to each other on a metal plate 3. The separation between the two arrays will be designated by letter S. The factors which affect the choice of distance S will be discussed later in this application in connection with FIG. 2. Collinear array 1 is fed by balun 4. Array 2 is fed by balun 5.

A zigzag antenna 6, fed by balun 7, is mounted parallel to plate 3 with its centerline located half way between the two collinear arrays 1 and 2. The spacing of the zigzag conductor from plate 3 may be made equal to or somewhat greater or less than the spacing of the dipoles, such as 8, in the collinear arrays from plate 3. For example, the spacing between the centerline of the zigzag conductor may be $0.10\lambda_1$, when the spacing of the centerline of the dipole conductor from plate 3 is $0.09\lambda_2$, where $\lambda_1$ and $\lambda_2$, are the space wavelengths at the frequency at which each antenna is excited. These wavelengths would be equal if the same frequency were fed to both the zigzag and the collinear arrays as would be the case if the combined panel antenna were operated by a radiator sending out circularly polarized waves.

The spacing of a radiating conductor controls the radiation resistance as well as the characteristic impedance of the conductor. For a given spacing the attenuation along a zigzag conductor is decreased by increasing its characteristic impedance. This can be done, to some degree, by decreasing the effective diameter of the zigzag conductor. The same is true of the dipoles in the collinear array. The effective diameters of the dipoles in the collinear array can be conveniently made fairly large, for example, 045λ. The larger effective diameter results in increased attenuation per unit length of the array. The collinear array, however, has a shorter length than the zigzag, typically by a factor around 1.375. The characteristic impedance $Z_2$ of the dipole conductors, spaced 0.09λ from the sheet is about 124 ohms. The characteristic impedance $Z_1$ of the zigzag conductor spaced 0.10λ from the sheet is about 188 ohms. The ratio $Z_1/Z_2=188/124=1.52$ is greater than the ratio of the lengths of the two conductors. If the zigzag were at the same spacing from the plate as the dipoles in the array one could expect the radiation resistances, per unit length, to be approximately equal so that the greater length of the zigzag conductor would be more than compensated by the higher characteristic impedance because one may expect the attenuation in decibells per unit length to be directly proportional to the radiation resistance per unit length and inversely proportional to the characteristic impedance. Since the radiation resistance increases roughly in proportion to the square of the spacing when the spacings are small, one would expect that proper spacing for the zigzag would be $1.70/1.375\times0.09=0.10$ wavelengths. A larger spacing would result in greater attenuation along the zigzag and, therefore, a somewhat broader pattern than that of the collinear array. A wider radiation pattern was observed under such conditions. These patterns are in the planes passing through the line along the sheet half way between the two collinear arrays.

Even if the zigzag conductor diameter were decreased by a factor of 2 the attenuation along the zigzag would still have to remain at a spacing close to that of dipoles in the collinear array. A small zigzag conductor results in a higher characteristic impedance. Since a balanced line or a balun feeding the zigzag sees an impedance equal to approximately twice the characteristic impedance, conductors of small diameters are less desirable, for even with a 0.0172 wavelength conductor diameter and a balun of the type which divides the input impedance by 4, one would still see ¼ and 375=95 ohm impedance at the coaxial input to the balun, assuming no further transformation in the balun. A lower impedance would be more convenient to feed. From this point of view smaller spacings and large conductor diameters are desirable.

The separation S between the two collinear arrays, as shown in FIG. 2, controls the radiation pattern in the plane perpendicular to the dipoles in these arrays. The radiation pattern in the plane perpendicular to the collinear arrays is given by the array factor:

$$A = \cos\left(\frac{\pi S}{\lambda}\cos\phi\right)\sin\left(\frac{2\pi\sigma}{\lambda}\sin\phi\right)$$

where $\sigma$ is the spacing from plate 3 of the centerlines of the dipoles in arrays 1 and 2. Angle $\phi$ is the angle measured from plate 3.

Figure 4:
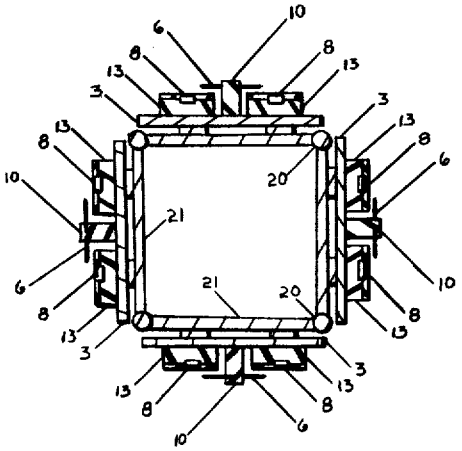
FIG. 4 shows a top view of a square tower with four panel antennas of FIG. 1 mounted on the four faces of the tower.

The behaviour of the array factor A at $\phi=45°$ is important when two or more panels are to be used at right angles to each other as would be the case if, for example, the panels were mounted on the faces of a square tower as shown in FIG. 4. FIG. 4 shows the top view of a square tower around which are mounted four combined panel antennas of FIG. 1. In this figure 20 is a column of the tower; 21 is a horizontal member of the tower. The diagonal members are assumed to be located below the top horizontal members and, therefore, are not shown in FIG. 4. For directional coverage one, two or three combined panel antennas of FIG. 1 would be mounted around the tower depending on the sectors of the service area to be covered. For omnidirectional service four panel antennas of FIG. 1 would be used and excited in the same relative phases.

Each combined panel antenna may be used to radiate two bands of frequencies. One band of frequencies being radiated as horizontally polarized waves and the other band of frequencies radiated as vertically polarized waves. This, for example, would be the case if the antennas were used for radiating two closely spaced non-overlapping channels allocated in the United States for Multipoint Distribution Service. In such a case omnidirectional patterns in both polarizations can be obtained by feeding all collinear arrays in the same relative phases with each other and feeding the zigzag antennas in the same phase with each other. Phasing of the zigzags with respect to the collinear arrays has no meaning in this case.

When the combined antennas are to be used to radiate circularly polarized waves over one band of frequencies, it is necessary to feed each zigzag antenna in a predetermined relative phase with respect to the two collinear arrays mounted on the same panel. The determination of the proper relative phases at the input to the zigzag antenna with respect to the combined input of the two collinear arrays is made by observing the polarization of the radiated signal. The sense of rotation, as well as the so called circularity of the signal, is observed and relative phase adjusted for desired sense of rotation and for optimum circularity. The sense of rotation can be reversed by rotating the balun supplying the zigzag. These adjustments would normally be made at the factory antenna range.

For omnidirectional service it is important that the sense of rotation be the same for all four panels and that the relative phases be substantially equal.

When $S=\lambda/2$, at $\phi=45°$ $A=0.444\times0.732=0.325$ for $S/\lambda=0.6$, $A=0.173$ and for $S/\lambda=0.4$, $A=0.462$ These results indicate that for use on square towers spacings somewhat less than a half-wavelength would result in more nearly circular patterns.

In the arrangement of FIG. 4, 20 is a column of the supporting tower; 21 is a horizontal member of the tower. The diagonal members are below the horizontal members in the view of FIG. 4 and they are not shown. Four panels such as panel 3 in FIG. 1 are shown mounted on the faces of the tower.

When the number of panel antennas of the type shown in FIG. 1 are to be installed around a tower having more than four faces, wider spacings may be used. When two or more panels are to be mounted next each other on a flat sheet to obtain narrow beams in the horizontal as well as vertical planes the spacing S is as critical as when four panels are mounted on a square tower if a substantially smooth pattern in plane perpendicular to the collinear arrays is desired.

The embodiment of the present invention described herein, represents the best known use of the invention and incorporates the principal features of the invention. Various modifications in construction, arrangement and operation of the apparatus illustrated in this embodiment can be made within the scope and spirit of the invention set forth in the appended claims.

I claim:

1. A panel antenna for cross polarized waves comprising:

(a) a metal panel on which are mounted two parallel collinear dipole arrays spaced at a distance between 0.3 wavelength and 0.6 of the wavelength from each other, and (b) a zigzag antenna located half way between the two collinear arrays with its longitudinal axis parallel to the arrays and located substantially half way between the centers of the two collinear arrays.

2. A panel antenna as in claim 1 wherein the zigzag conductor has an effective diameter which is smaller than the effective diameter of the dipoles.

3. Panel antenna as in claim 1 wherein the two collinear arrays are fed in the same relative phases.

4. Panel antenna as in claim 3 wherein the two collinear arrays and the zigzag are fed from the same high frequency source.

5. Panel antenna as in claim 3 wherein the two collinear arrays and the zigzag are fed from two different sources of high frequency power.

6. An antenna comprising a plurality of panel antennas as in claim 1 mounted parallel to each other at equal intervals and at the same level around a vertical cylinder.

7. An antenna as in claim 6 wherein all collinear arrays are energized in the same relative phases with each other and all zigzag antennas are also energized in the same phases with each other.

8. Antenna as in claim 7 wherein the cylinder is a square tower.

9. An antenna as in claim 1 wherein the collinear arrays are longitudinally staggered with respect to each other by one half of the full cycle of the zigzag antenna.

* * * * *